United States Patent [19]

Yoshida et al.

[11] Patent Number: 4,846,939

[45] Date of Patent: Jul. 11, 1989

[54] METHOD FOR PRODUCING A GRAIN-ORIENTED ELECTRICAL STEEL SHEET HAVING AN ULTRA LOW WATT LOSS

[76] Inventors: Makoto Yoshida; Seijun Higuchi; Teruaki Izaki; Osamu Tanaka, all of c/o Yawata Works, Nippon Steel Corporation, 1-1-1, Edamitsu, Yahatahigashi-ku, Kitakyushu-shi, Fukuoka, Japan

[21] Appl. No.: 300,143

[22] Filed: Jan. 23, 1989

Related U.S. Application Data

[63] Continuation of Ser. No. 593, Jan. 6, 1987, abandoned.

[30] Foreign Application Priority Data

Jan. 11, 1986 [JP] Japan ..... 61-2880

[51] Int. Cl.[4] ..... H01F 1/04

[52] U.S. Cl. ..... 204/15; 148/111; 148/113; 204/27; 204/29; 204/34; 204/37.1

[58] Field of Search ..... 204/15, 27, 29, 34, 204/37.1, 37.3, 38.1; 148/111, 112, 113

[56] References Cited

U.S. PATENT DOCUMENTS

| | | | |
|---|---|---|---|
| 3,990,923 | 11/1976 | Takashina et al. | 148/111 |
| 4,160,705 | 7/1979 | Arendt et al. | 204/37.1 |
| 4,203,784 | 5/1980 | Kuroki et al. | 148/111 |
| 4,213,804 | 7/1980 | Datta | 148/113 |
| 4,363,677 | 12/1982 | Ichiyama et al. | 148/111 |
| 4,548,656 | 10/1985 | Kimoto et al. | 148/111 |
| 4,553,409 | 8/1985 | Benford | 148/111 |
| 4,554,029 | 11/1985 | Schoen et al. | 148/112 |
| 4,618,377 | 10/1986 | Nakamura et al. | 148/6.15 R |

FOREIGN PATENT DOCUMENTS

| | | | |
|---|---|---|---|
| 1198036 | 12/1985 | Canada | 148/308 |
| 0047129 | 4/1985 | European Pat. Off. . | |
| 57-188810 | 11/1982 | Japan | 148/113 |
| 59-197520 | 11/1984 | Japan | 148/113 |
| 60-103124 | 6/1985 | Japan . | |
| 61-124584 | 6/1986 | Japan | 148/113 |
| 722959 | 3/1980 | U.S.S.R. | 148/111 |
| 2167324 | 5/1986 | United Kingdom . | |

OTHER PUBLICATIONS

Metal Finishing Guidebook and Directory for 1978, Metals and Plastics Publications, Inc., Hackensack, N.J., pp. 160–161, 166–167.

*Primary Examiner*—John F. Niebling
*Assistant Examiner*—William T. Leader
*Attorney, Agent, or Firm*—30

[57] ABSTRACT

The heat resistant subdivision of magnetic domains of a grain-oriented electrical steel sheet for improving the watt loss characterized by forming intruders therein is improved by pickling the steel sheet prior to the electroplating of the intrudable means. The partly exposed steel sheets are pickled by $HNO_3$, $H_2SO_4$ containing $Fe^{3+}$, HCl containing $Fe^{3+}$, and/or $HBF_4$.

5 Claims, 1 Drawing Sheet

METHOD FOR PRODUCING A GRAIN-ORIENTED ELECTRICAL STEEL SHEET HAVING AN ULTRA LOW WATT LOSS

This application is a continuation of application Ser. No. 000,593 filed Jan. 6, 1987, now abandoned.

BACKGROUND OF THE INVENTION

1. Field of the Invention

The present invention relates to a method for producing a grain-oriented electrical steel sheet having an ultra low watt loss. More particularly, the present invention relates to a method for producing a grain-oriented electrical steel sheet having an ultra low watt loss, in which the improvement of the watt loss due to a subdivision of magnetic domains does not disappear even after stress relief annealing is carried out during, for example, the production of a wound core.

2. Description of the Related Art

The grain-oriented electrical steel sheet is used mainly as the core material of transformers and other electrical machinery and devices, and must, therefore, have excellent excitation and watt-loss characteristics. In the grain-oriented electrical steel sheet, secondary recrystallized grains are developed which have a (110) plane parallel to the rolled surface and a <001>axis parallel to the rolling direction. These grains have the so-called Goss texture formed by utilizing the secondary recrystallization phenomenon. Products having improved exciting and watt-loss characteristics can be produced by enhancing the orientation degree of the (110) <001>orientation and lessening the deviation of the <001>axis from the rolling direction.

Note, the enhancement of the (110) <001>orientation leads to a coarsening of the crystal grains and an enlargement of the magnetic domains due to a passing of domain walls through the grain boundaries. There occurs, accordingly, a phenomenon such that the watt loss cannot be proportionally lessened to enhance the orientation.

Japanese Examined Patent Publication No. 58-5968 proposes to lessen the watt loss by eliminating the non-proportional phenomenon regarding the relationship between the orientation enhancement and the watt loss-reduction. According to this proposal, a ball or the like is pressed against the surface of a finishing-annealed, grain-oriented sheet so as to form an indentation having depth of 5 $\mu$ or less. By this indentation, a linear, minute strain is imparted to the steel sheet, with the result that the magnetic domains are subdivided.

Japanese Examined Patent Publication No. 58-26410 proposes to form at least one mark on each of the secondary recrystallized crystal grains by means of laser-irradiation, thereby subdividing the magnetic domains and lessening the watt loss.

The materials having ultra-low watt loss can be obtained, according to the methods disclosed in the above Japanese Examined Patent Publications Nos. 59-5868 and 58-26410, by imparting a local minute strain to the sheet surface of a grain-oriented electrical steel sheet.

SUMMARY OF THE INVENTION

It is an object of the present invention to industrially stably produce a grain-oriented electrical steel sheet which does not undergo a deterioration of the magnetic properties even after, for example, stress-relief annealing is carried out, or after a subdivision of magnetic domains, and which has considerably improved magnetic properties and an ultra low watt loss.

The present inventors carried out experiments during their investigations into providing a heat resistant subdivision of the magnetic domains such that the improvement of the watt loss is not lost even after a heat treatment is carried out, e.g., stress relief annealing, after a subdivision of magnetic domains, and during the manufacture of wound cores, and thus producing at a high stability a grain-oriented electrical steel sheet having an ultra low watt loss.

It is known that imparting a small strain on the surface of a finished annealed grain-oriented electrical steel sheet, such as by mechanical means forming a small indentation on the surface or by optical means such as laser irradiating the surface, the magnetic domains are used to subdivide and the watt loss characteristics are improved. British Patent Specification No. 2,167,324A discloses that if a material of a different composition than the steel, such as Sb or an Sb alloy, is placed on the surface of the steel sheet in the region of the strain, it can be caused to intrude into the steel sheet and stabilize the subdivided magnetic domains even after stress relief annealing. Such a material is referred to as intruders or intrudable means.

As a result of the experiments mentioned above, it was discovered that: the nuclei of magnetic domains are generated on both sides of the intruders; these nuclei causes the subdivision of magnetic domains when the steel sheet is magnetized, and thus an extremely low watt loss is obtained; the effect of reducing the watt loss does not disappear even after the steel sheet is annealed, for example, stress-relief anealed; and an extremely low watt loss is maintained.

The present inventors made further investigations into effectively carrying out the subdivision of magnetic domains with a high degree of stability. It was then discovered that, when a patch of a surface film such as a glass film and an insulating coating of a grain-oriented electrical steel sheet is removed, causing strain to be simultaneously imparted to the parts of the steel sheet having the film removed , pickling is then carried out by a pickling liquid containig one or more of nitric acid, sulfuric acid containing trivalent iron, hydrochloric acid containing trivalent iron, and borofluoric acid and, subsequently, an intrudable means is electroplated on the parts of the steel sheet having the film removed , then the intrudable means is caused to react stably and at a high current efficiency with a steel sheet to effectively form intruders which have an extremely strong bond with a steel sheet, are difficult to peel, and therefore, cause a reduction in the watt loss.

The present invention is based on the above discovery and is characterized by: removing a surface film, such as a glass film and an insulating coating of a grain-oriented electrical steel sheet such that the removed parts are spaced therebetween; subsequently pickling with a pickling liquid containing one or more of nitric acid, sulfuric acid containing a trivalent iron, hydrochloric acid containing a trivalent iron, and borofluoric acid; electroplating an intrudable means on the film-removed parts of a grain-oriented electrical steel sheet to provide a deposition amount of 0.5 g/m$^2$ or more; and, if necessary, heat-treating or forming an insulating coating, thereby forming intruders distinguished from steel either in composition or structure, and subdividing the magnetic domains.

The term "intrudable means" herein indicates the material capable of being forced into a steel sheet by plating. Metals, for example, Sb, Cu, Sn, Zn, Fe, Ni, Cr, Mn, Mo, Co and the like, as well as their alloys can be used as the intrudable means.

The term "intruder" herein includes clusters, grains, lines, or the like formed by an intrusion of an intrudable means deposited on a steel sheet so that said means intrude alone, or intrude in combination with a steel part, an insulating coating of a steel sheet, or the components of a heating atmosphere.

A preferred intruder is one formed by Sb metal, Sb alloy, Sb mixture, or Sb compound, alone or combined with the steel body of a grain-oriented electrical steel sheet. The intruder containing Sb can cause the subdivision of the magnetic domains and drastically lessen the watt loss.

The heat resistant subdivision of the magnetic domains is carried out as follows. A patch of the surface film, such as the glass film, oxide film, and insulating coating, which are formed on a finishing annealed grain-oriented electrical steel sheet, is removed, by laser-irradiation, grinding, machining, scarfing, chemical polishing, shot blasting, and, the like, so as to expose the metal base of a steel sheet, and at the same time, strain is imparted.

Subsequently, the steel sheet is pickled. The effect of the pickling is described later in detail.

The experiments by present inventors revealed that some glass film or insulating coating frequently remains at locations from which they have been removed, and the remaining film induces defects.

When small amount of remaining film is present at removal locations, not only is the precipitation efficiency of metal low in a subsequent electroplating step of an intrudable metal, but also disadvantages some times arise such that the metal, which has been intentionally precipitated, is liable to peel during the shearing, forming, and annealing of the steel sheet. The present inventors accordingly carried out many experiments to determine the measures needed to counteract peeling of the intrudable metal, and as a result, a pickling method for removing the remaining film was discovered.

It was discovered that the pickling liquids used in the pickling method should contain one or more of nitric acid, sulfuric acid containing trivalent iron, hydrochloric acid containing trivalent iron, and borofluoric acid. Any one of these pickling acids has a function of dissolving the iron base in a short period of time, with the result that the partially exposed iron base is dissolved, and the pickling is further advanced to dissolve the iron base beneath the partially remaining film thereby simultaneously removing the remaining insulating film. When the remaining insulating film is removed by pickling, the precipitation efficiency is enhanced and the plating adhesivity is improved. This is shown in FIG. 1 and Table 1 as the experimental data.

Figure 2:
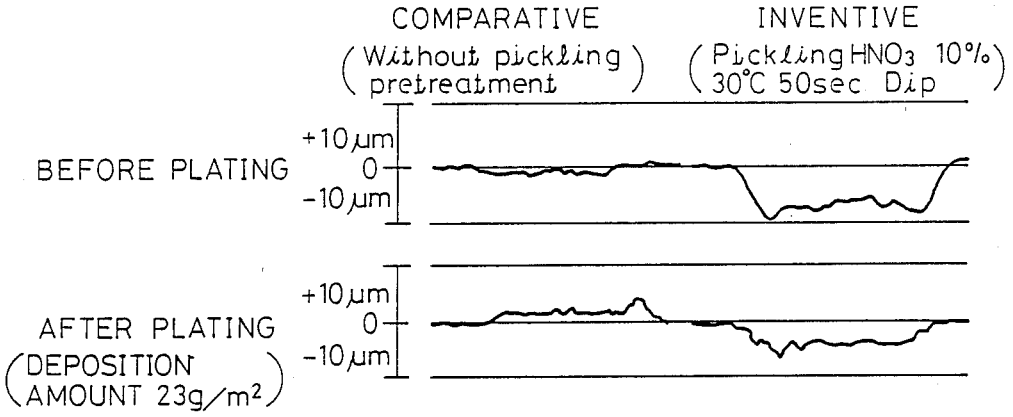

and,

FIG. 2 is a graph showing measurement data of the roughness (surface roughness) of a plated part according to the present invention.

DESCRIPTION OF THE PREFERRED EMBODIMENTS

Figure 1:
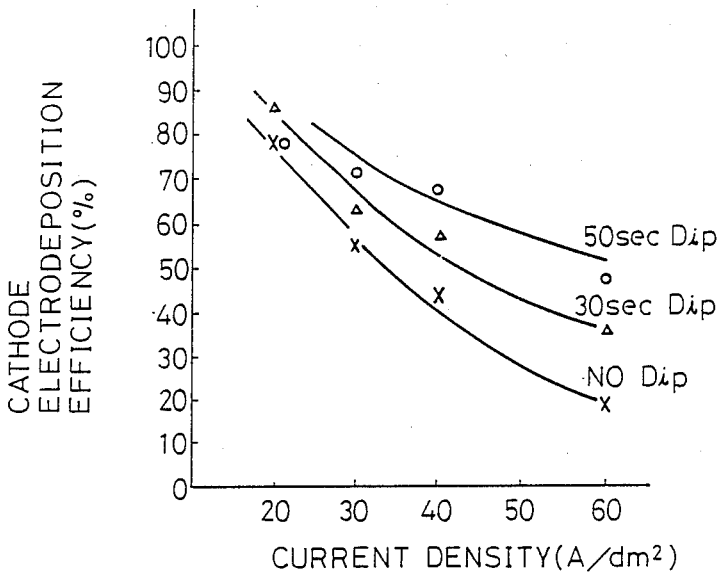
FIG. 1 is a graph showing one experimental result of an investigation into the influence of current density upon the cathode elecrodeposition efficiency.

In the experiment, the data of which is shown in FIG. 1, grain-oriented electrical steel sheets, which were finishing annealed and treated with an insulating coating, were subjected to laser irradiation in a direction perpendicular to the rolling direction and at a distance of 5 mm, and subsequently, the steel sheets were pickled by a 10% $HNO_3$ pickling liquid followed by Sb electroplating.

The Sb-plating condition were: citric acid bath; current density of 900 c/dm$^2$ (constant).

The pickling condition was: 10% $HNO_3$; 30° C.

TABLE 1

| No. | Pickling Condition ($HNO_3$ 10%) 30° C. | Plating · Deposition Amount of Sb (g/m$^2$) | Adhesivity of Plating* (Taping Test) |
|---|---|---|---|
| 1 | Dipping Time (0 sec) | 20~26 | x |
| 2 | Dipping Time (10 sec) | " | Δ |
| 3 | Dipping Time (20 sec) | " | Δ |
| 4 | Dipping Time (30 sec) | " | o |
| 5 | Dipping Time (50 sec) | " | 0 |

* Remarks-evaluation of plating adhesivity x: Peeling over entire surface

Δ: Partial peeling o: No peeling

The pickling also has an effect of rendering the plates parts into a concave shape. When the plating is carried out while leaving the unsatisfactorily film-removed parts as they are, the film-removed and then plated parts become slightly convex, so that the steel sheets, which are stacked on top of each other and annealed, may stick together. When such sticking occurs, not only is the forming efficiency of the wound cores lessened, but also the electric and magnetic properties are adversely influenced. The pickling pretreatment renders the parts to be plated into a concave shape, with the result that the intruders plated thereon retain the concave shape or are rendered flat. In this case, the sticking phenomenon does not occur, even if the stacking annealing is carried out.

Referring to FIG. 2, which shows the roughness measurement results, it is necessary in the plating to take the deposited amount into consideration. The deposited amount must be 0.5 g/m$^2$ or more in order to subdivide the magnetic domains of a steel sheet. The plating at an amount greater than this deposited amount leads to the formation of intruders in the form of an alloy layer, diffusion substance, and the like, in the steel sheet, which are distinguished from the steel sheet either in composition or structure, and hence, a heat resistant subdivision of the magnetic domains occurs. In addition, by controlling the deposited amount, the depth and amount of the intruders is varied. For example, when the deposited amount is increased, the depth and amount of intruders is increased, to greatly improve the watt loss-characteristic. That is, by controlling the deposited amount, the watt loss characteristic levels can be distinguishably varied while attaining a low watt loss. In addition, the heat treatment, which is carried out if necessary, promotes the forcing of the intruders into the steel sheet. This heat treatment is carried out at a temperature of 500 to 1200° C. by either continuous annealing or box annealing. This heat treatment may be utilized for baking an insulating coating, such as phosphoric acid, phosphate, chromic acid anhydride, and colloidal silica, applied prior to the heat treatment.

The present invention is hereinafter described by way of examples.

EXAMPLE 1

A silicon-steel slab, which consists, by weight %, of 0.080% of C, 3.22% of Si, 0.085% of Mn, 0.027% of Al, 0.022% of S, 0.07% of Cu, and 0.10% of Sn, and a balance of iron was hot-rolled annealed, and cold-rolled by a well known method to obtain 0.225 mm thick steel strips.

Subsequently, a decarburization step, a step of applying an annealing separator mainly composed of MgO, and a finishing annealing step, which steps are all well known were carried out. An insulating coating was formed after the finishing annealing. The samples obtained at this stage are denoted as "Prior to Treatment". The steel sheets, on which the insulating coating was applied, were irradiated with a laser in a direction approximately perpendicular to the rolling direction and at a distance of 5 mm so as to remove the glass film, insulating coating, and oxide film and to impart strain. The steel sheets were then dipped in various pickling liquids, shown in Table 2, and then electroplated with the plating metals (intrudable means) as shown in Table 2. The samples obtained from these steel sheets are denoted as "After Plating".

The steel sheets were then cut into pieces 3 mm in width and 4 cm in length, and twenty pieces were laminated and clamped at a clamping pressure of 60 kg. The stress relief annealing was then carried out at 850° C. for 2 hours. The samples obtained from these steel pieces are referred to as the "After Stress Relief Annealing" samples.

The deposited amount, electrodeposition efficiency, and plating adhesivity of "After Plating" samples were measured. The sticking of "After Stress Relief Annealing" samples was measured. In addition, the magnetic properties of "Prior to Treatment", "After Plating", and "Stress Relief Annealing" samples were measured. These results are collectively shown in Table 2.

TABLE 2

| Test No. | Pretreatment Condition by Pickling | Plated Metal (Intrudable means) | Depositing Amount (g/m$^2$) | Efficiency of Electrodeposition (%) | Adhesivity of Plating (Taping) | Sticking Property (Peeling Load g/9 cm$^2$) | Prior to Treatment: Watt Loss W17/50 (W/kg) | Prior to Treatment: Magnetic Flux Density $B_{10}$ (T) |
|---|---|---|---|---|---|---|---|---|
| | $HNO_3$ 10% 30° C. × 30 sec Dip | Sn | 23.8 | 95 | o | 43 | 0.90 | 1.939 |
| 2 | $HNO_3$ 10% 30° C. × 30 sec Dip | Sb | 14.2 | 57 | o | 35 | 0.91 | 1.940 |
| 3 | $H_2SO_4$ 15% $Fe^{3+}$ 2% 60° C. × 45 sec Dip | Zn | 24.3 | 97 | o | 50 | 0.89 | 1.941 |
| 4 | $H_2SO_4$ 15% $Fe^{3+}$ 2% 60° C. × 45 sec Dip | Ni | 23.0 | 92 | o | 45 | 0.90 | 1.938 |
| 5 | HCl 10% $Fe^{3+}$ 1.54 50° C. × 45 sec Dip | Sb | 13.8 | 55 | o | 48 | 0.91 | 1.939 |
| 6 | HCl 10% $Fe^{3+}$ 1.54 50° C. × 45 sec Dip | Ni | 23.3 | 93 | o | 36 | 0.92 | 1.937 |
| 7 | $HBF_4$ 10% 30° C. × 50 sec Dip | Zn | 24.0 | 96 | o | 50 | 0.89 | 1.940 |
| 8 | $HBF_4$ 10% 30° C. × 50 sec Dip | Sn | 23.3 | 93 | o | 41 | 0.91 | 1.938 |
| 9 | no | Sn | 18.8 | 75 | Δ | 95 | 0.90 | 1.940 |
| 10 | no | Sb | 11.0 | 44 | Δ | 105 | 0.90 | 1.940 |
| 11 | no | Zn | 21.3 | 85 | Δ | 122 | 0.89 | 1.941 |
| 12 | no | Ni | 21.8 | 87 | Δ | 87 | 0.91 | 1.937 |
| 13 | without/plating | — | — | — | — | — | 0.91 | 1.940 |

| Test No. | After Plating: Watt Loss W17/50 (W/kg) | After Plating: Magnetic Flux Density $B_{10}$ (T) | After Stress Relief Annealing: Watt Loss W17/50 (W/kg) | After Stress Relief Annealing: Magnetic Flux Density $B_{10}$ (T) | Remarks |
|---|---|---|---|---|---|
| 1 | 0.80 | 1.937 | 0.79 | 1.938 | Inventive Method |
| 2 | 0.78 | 1.939 | 0.77 | 1.939 | Inventive Method |
| 3 | 0.79 | 1.942 | 0.79 | 1.942 | Inventive Method |
| 4 | 0.80 | 1.939 | 0.80 | 1.938 | Inventive Method |
| 5 | 0.77 | 1.938 | 0.76 | 1.940 | Inventive Method |
| 6 | 0.81 | 1.936 | 0.80 | 1.936 | Inventive Method |
| 7 | 0.80 | 1.940 | 0.79 | 1.939 | Inventive Method |
| 8 | 0.81 | 1.939 | 0.81 | 1.939 | Inventive Method |
| 9 | 0.81 | 1.939 | 0.81 | 1.939 | Comparative |

TABLE 2-continued

| | | | | | |
|---|---|---|---|---|---|
| | | | | | Method |
| 10 | 0.80 | 1.941 | 0.80 | 1.940 | Comparative Method |
| 11 | 0.80 | 1.940 | 0.80 | 1.942 | Comparative Method |
| 12 | 0.81 | 1.937 | 0.81 | 1.936 | Comparative Method |
| 13 | — | — | 0.91 | 1.942 | Comparative Method |

* Remarks-evaluation of plating adhesivity (also in Table 3)

x: Peeling over entire surface

Δ: Partial peeling o: No peeling

EXAMPLE 2

A silicon-steel slab, which consists, by weight %, of 0.078% of C, 3.25% of Si, 0.082% of Mn, 0.028% of Al, 0.020% of S, 0.06% of Cu, and 0.09% of Sn, and a balance of iron, was hot-rolled, annealed, and cold-rolled by a well known method to obtain a 0.245 mm thick steel strips.

Subsequently, the decarburization, application of an annealing separator mainly composed of MgO, and finishing annealing were carried out.

A coating solution for an insulating coating was applied and then a heat treatment for baking and flattening annealing was carried out in one process.

The samples obtained at this stage are denoted as "Prior to Treatment". The steel sheets, on which the insulating coating was applied, were irradiated with a laser in a direction perpendicular to the rolling direction and at a distance of 10 mm so as to remove the glass film, insulating coating, and oxide film and to impart strain. The steel sheets were then dipped in an acid solution containing 10% of $HNO_3$, and electrodeposited with Sb at a deposited amount of 20 g/m$^2$.

The samples obtained from these steel sheets are denoted as "After Plating".

Subsequently, the stress relief annealing was carried out under the same conditions as Example 1.

The samples obtained from these steel sheets are referred to as the "After Stress Relief Annealing".

The deposited amount, electrodeposition efficiency, and plating adhesivity of "After Plating" samples were measured. The sticking of "After Stress Relief Annealing" samples was measured. In addition, the magnetic properties of "Prior to Treatment", "After Plating", and "Stress Relief Annealing" samples were measured. These results are collectively shown in Table 3.

TABLE 3

| Test No. | Adhesivity of Plating* (Taping) | Sticking Property (Peeling Load) (g/9 cm$^2$) | Prior to Treatment Watt Loss W17/50 (W/kg) | Prior to Treatment Magnetic Flux Density $B_{10}$ (T) | After Planting Watt Loss W17/50 (W/kg) | After Planting Magnetic Flux Density $B_{10}$ (T) | After Stress Relief Annealing Watt Loss W17/50 (W/kg) | After Stress Relief Annealing Magnetic Flux Density $B_{10}$ (T) | Remarks |
|---|---|---|---|---|---|---|---|---|---|
| 1 | o | 40 | 0.92 | 1.938 | 0.80 | 1.939 | 0.79 | 1.938 | Inventive Method |
| 2 | — | — | 0.92 | 1.938 | — | — | 0.92 | 1.937 | Comparative Method (without plating) |

As is understood from the above examples, the intrudable means is plated at a high electrodeposition efficiency according to the present invention. In addition, the adhesivity of the plating is improved, and a grain-oriented electrical steel sheet with an extremely low watt loss is stably produced. Furthermore, the sticking property at the stress relief annealing is improved.

We claim:

1. In a method for producing a grain-oriented electrical steel sheet having an ultra low watt loss including the steps of:

providing a finished annealed grain-oriented electrical steel sheet having a surface film on the surface thereof;

removing said surface film from selected spaced apart portions of the surface of said sheet, said removing being accomplished by means which simultaneously imparts a strain on the surface of said sheet at said selected spaced aparts portions of the surface where said surface film is removed;

electroplating an intrudable means in a deposition amount of 0.5 g/m$^2$ or more on said selected spaced apart portions of said sheet having said surface film removed, said intrudable means being a material distinguished from the steel either in composition or structure; and causing said intrudable means to intrude into said steel sheet at said selected spaced apart portions for thereafter subdividing magnetic domains of the steel sheet;

the improvement comprising: subsequent to said simultaneous surface film removing and strain imparting step and prior to said electroplating step, pickling said sheet with a pickling liquid containing at least one member selected from the group consisting of nitric acid, sulfuric acid containing trivalent iron, hydrochloric acid containing trivalent iron, and borofluoric acid, said pickling step dissolving naked steel exposed by said surface film removing step in said spaced apart portions, removing film in said spaced apart portions unremoved by said surface film removing step, and forming a concavity in the surface of the sheet at said spaced apart portions, whereby said intrudable means are plated at a high electrodeposition efficiency and adhesivity of said plated intruder means is improved, thereby stably producing said grain-oriented electrical steel sheet having an ultra low watt loss.

2. A method according to claim 1, characterized by heat treating the steel sheet with an electroplated intrudable means thereon.

3. A method according to claim 2, wherein said heat treatment is carried out at a temperature of from 500° to 1200° C.

4. A method according to claim 1 or 2, wherein said intrudable means is one member selected from the group consisting of Sb, Cu, Sn, Zn, Fe, Ni, Cr, Mn, Mo, Co and their alloys.

5. A method according to claim 1 wherein said pickling liquid contains at least one member selected from the group consisting of nitric acid, sulfuric acid containing a trivalent iron and hydrochloric acid containing trivalent iron.

* * * * *

UNITED STATES PATENT AND TRADEMARK OFFICE

CERTIFICATE OF CORRECTION

PATENT NO. : 4,846,939

DATED : July 11, 1989

INVENTOR(S) : M. Yoshida, et al.

It is certified that error appears in the above-identified patent and that said Letters Patent is hereby corrected as shown below:

Column 2, line 30, change "causes" to --cause--.

Column 2, line 34, change "anealed" to --annealed--.

Column 2, line 44, change "containig" to --containing--.

Column 4, line 23, change "0" to --o--.

Column 4, line 30, change "plates" to --plated--.

Column 5, Table 2, Test 5, change "1.54" to --1.5%--.

Column 5, Table 2, Test 6, change "1.54" to --1.5%--.

Column 6, Table 2, column headed "Adhesivity of Plating" change to --Adhesivity of Plating*--.

Column 8, line 26, change "aparts" to --apart--.

Column 10, line 8, delete "a" before "trivalent".

Signed and Sealed this

Fifteenth Day of May, 1990

*Attest:*

*Attesting Officer*

HARRY F. MANBECK, JR.

*Commissioner of Patents and Trademarks*